US008740572B2

(12) United States Patent
Hoebel et al.

(10) Patent No.: US 8,740,572 B2
(45) Date of Patent: Jun. 3, 2014

(54) WEAR-RESISTANT AND OXIDATION-RESISTANT TURBINE BLADE

(75) Inventors: Matthias Hoebel, Windisch (CH); Günter Ambrosy, Baden-Dättwil (CH); Felix Reinert, Wettingen (CH); Stephane Barril, Birmenstorf (CH)

(73) Assignee: Alstom Technology Ltd., Baden (CH)

( * ) Notice: Subject to any disclaimer, the term of this patent is extended or adjusted under 35 U.S.C. 154(b) by 803 days.

(21) Appl. No.: 12/917,114

(22) Filed: Nov. 1, 2010

(65) Prior Publication Data

US 2011/0103968 A1 May 5, 2011

(30) Foreign Application Priority Data

Nov. 2, 2009 (DE) ..... 10 2009 051 661

(51) Int. Cl.
*F01D 5/28* (2006.01)

(52) U.S. Cl.
USPC ..... 416/241 R; 415/173.1; 415/173.6

(58) Field of Classification Search
USPC ..... 416/241 R, 241 A, 189; 415/173.4, 415/173.6, 174.4
See application file for complete search history.

(56) References Cited

U.S. PATENT DOCUMENTS

| | | | | |
|---|---|---|---|---|
| 4,390,320 | A * | 6/1983 | Eiswerth | 416/97 R |
| 6,194,086 | B1 | 2/2001 | Nenov et al. | |
| 6,811,898 | B2 * | 11/2004 | Ohara et al. | 428/697 |
| 7,140,952 | B1 * | 11/2006 | Juneau et al. | 451/54 |
| 7,473,072 | B2 * | 1/2009 | Malak et al. | 415/173.4 |
| 7,510,370 | B2 * | 3/2009 | Strangman et al. | 415/173.4 |
| 7,586,061 | B2 | 9/2009 | Hoebel et al. | |
| 8,021,120 | B2 * | 9/2011 | Schrey et al. | 416/224 |
| 2010/0322780 | A1 | 12/2010 | Manier | |

FOREIGN PATENT DOCUMENTS

| | | | |
|---|---|---|---|
| DE | 102004059904 | A1 | 6/2006 |
| EP | 1245787 | A2 | 10/2002 |
| EP | 1476272 | B1 | 11/2004 |
| GB | 2010982 | A | 7/1979 |
| GB | 2075129 | A | 11/1981 |
| WO | 2009083000 | A1 | 7/2009 |

* cited by examiner

*Primary Examiner* — Ninh H Nguyen
(74) *Attorney, Agent, or Firm* — Buchanan Ingersoll & Rooney PC

(57) ABSTRACT

A wear- and oxidation-resistant turbine blade and a method for producing the blade are provided. At least portions of the surface of the main blade section are provided with at least one first protective coating comprised of oxidation-resistant material, the first, oxidation-resistant coating is a metallic coating, which is optionally covered by a ceramic thermal barrier coating. The metallic first protective coating is arranged at least at the inner and outer crown edge of the blade tip, but not at the radially outer blade tip. The radially outer blade tip of the turbine blade is comprised of a second, single- or multi-layer wear- and oxidation-resistant protective coating, which is built up by laser metal forming and is comprised of abrasive and binder materials. The second protective coating on the blade tip overlaps along the outer and/or inner crown edge at least partially with the first, metallic protective coating arranged there.

16 Claims, 5 Drawing Sheets

WEAR-RESISTANT AND OXIDATION-RESISTANT TURBINE BLADE

FIELD OF INVENTION

The invention deals in the field of power plant engineering and materials science. It relates to a wear-resistant and oxidation-resistant turbine blade and also to a method for producing such a wear-resistant and oxidation-resistant turbine blade.

BACKGROUND

The reduction of leakage losses in turbines has been the subject of intensive development work for several decades. During operation of a gas turbine, relative movement between the rotor and the housing is unavoidable. The resultant wear of the housing or wear of the blades has the effect that the sealing action is no longer provided. As a solution to this problem, a combination of thick coatings which can be ground away on the heat shield and abrasive protective coatings on the blade tips is provided.

Methods for applying additional coatings to blade tips or for increasing the resistance to wear by suitable modification of the blade tip have been known even since the 1970s. Various methods have likewise been proposed for simultaneously making such protective coatings resistant to frictional contacts and oxidation caused by the hot gas by a combination of abrasive particles (carbides, nitrides, etc.) with oxidation-resistant materials. Many of the proposed methods are expensive and complex to implement, however, and this makes commercial use more difficult.

One of the popular strategies therefore lies in dispensing entirely with the protection of the blade tip against wear and providing the heat shield with special porous, ceramic rub-in coatings. Owing to their high porosity, these can also be rubbed in to a certain extent by unprotected blade tips. However, considerable technical risks are associated with this method, since the porous, ceramic rub-in coatings do not ensure the same resistance to erosion as dense coatings. A further risk lies in operational changes to the porous, ceramic rub-in coatings (densification by sintering), which can have a negative effect on the tribological properties. For this reason, a combination with wear-resistant (abrasive) blade tips is expedient when using ceramic protective coatings on heat shields.

In recent decades, a plurality of methods for producing abrasive blade tips have been developed as shown in, for example, U.S. Pat. No. 6,194,086 B1. Although the use of laser metal forming (LMF) to build up abrasive blade tips has been known since the start of the 1990s (see for example DE 10 2004 059 904 A1), this method is still used rarely on an industrial scale.

SUMMARY

The present disclosure is directed to a turbine blade for a turbine rotor. The blade has a main blade section, including a blade tip, which extends in a radial direction and is formed at the blade tip either as a crown, with an inner and outer crown edge extending in the radial direction, or as a shroud with a web, which extends in the radial direction and has lateral edges. At least portions of the surface of the main blade section are provided with at least one first protective coating of an oxidation-resistant material, the at least one first, oxidation-resistant protective coating is a metallic coating, in particular an MCrAlY coating. The first protective coating is arranged at least at the inner and/or outer crown edge or at the web edges, the first protective coating is not present at the radially outer blade tip of the turbine blade. The radially outer blade tip includes a second, at least single-layer wear-resistant and oxidation-resistant protective coating which is built up by laser metal forming. The second protective coating on the blade tip overlaps along the outer and/or inner crown edge or the web edges at least partially with the first, metallic protective coating arranged there.

In a further aspect, the present disclosure is directed to a method for producing the above turbine blade. The method includes coating, in a preceding production step, at least portions of the surface of the main blade section of the turbine blade with the oxidation-resistant, metallic protective coating, in particular the MCrAlY coating and an oxidation-resistant, ceramic thermal barrier coating is optionally applied to the protective coating. The method also includes removing the at least one oxidation-resistant protective coating on the radially outer blade tip by controlled machining, in particular grinding away, CNC milling and/or chemical coating removal. The method also includes applying the wear-resistant and oxidation-resistant protective coating to the blade tip in one layer or in a plurality of layers by laser metal forming, such that said coating overlaps along the outer and/or inner crown edge or the web edges at least partially with the first, metallic protective coating applied beforehand, but not with the ceramic thermal barrier coating optionally applied beforehand.

BRIEF DESCRIPTION OF THE DRAWINGS

The invention is explained in more detail below on the basis of exemplary embodiments and with reference to FIGS. 1 to 7.

The drawings show exemplary embodiments of the invention.

DETAILED DESCRIPTION OF THE PREFERRED EMBODIMENTS

Introduction to the Embodiments

Figure 1:
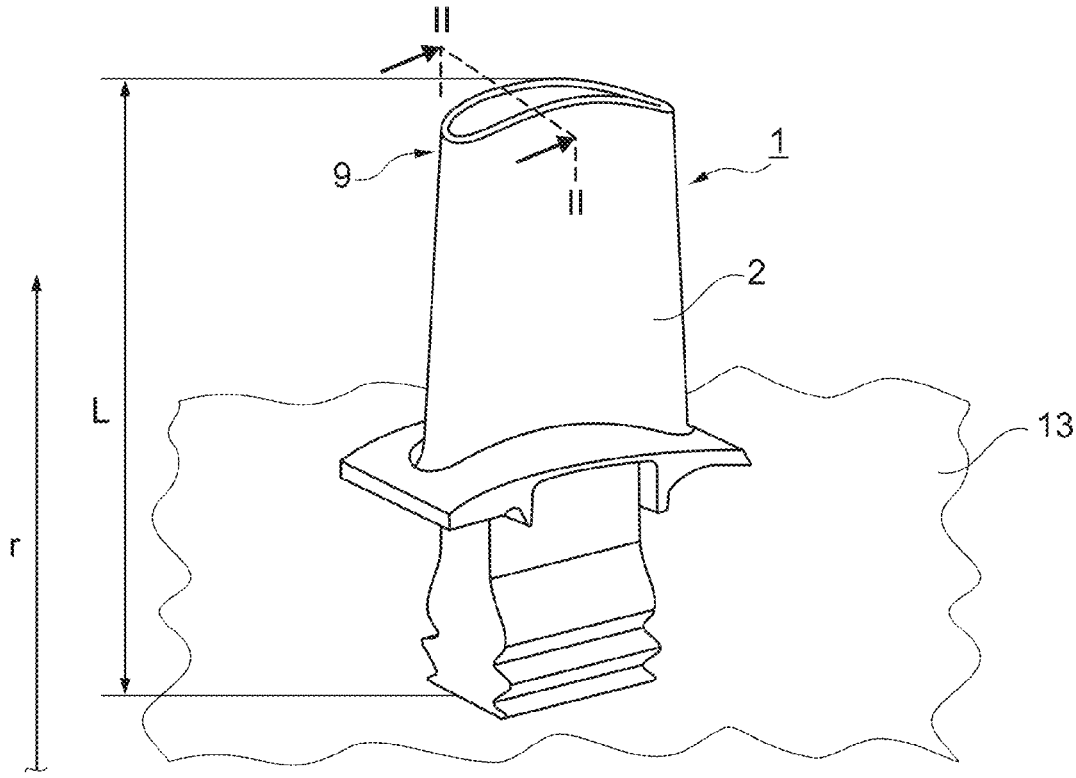
FIG. 1 shows a turbine blade for the rotor of a gas turbine having a blade tip formed as a crown according to a first exemplary embodiment of the invention.

The aim of the invention is to avoid the disadvantages of the known prior art. The invention is based on the object of developing a wear-resistant and oxidation-resistant turbine blade which can be used both for producing new parts and for reconditioning (retrofitting), where the production of said turbine blade requires only minimum adaptation of the existing production process.

The special feature of the embodiment described here of such a component is the best possible compatibility with conventional turbine blades and the processes for producing the latter. This requires only a small outlay to adjust current production sequences and opens up very interesting prospects for reconditioning and retrofitting. This object is achieved in that the wear-resistant and oxidation-resistant turbine blade having a blade tip, that extends in the radial direction and is formed at the blade tip either as a crown with an inner and outer crown edge extending in the radial direction or as a shroud with a web, which extends in the radial direction and has lateral edges, At least certain zones on the surface of the main blade section are provided with at least one first protective coating made up of an oxidation-resistant material. The at least one first, oxidation-resistant protective coating is a metallic coating, in particular an MCrAlY coating (M=Ni, Co or a combination of both elements). The first protective coating is arranged at least at the inner and outer crown edge or web edge. The first protective coating is not present at the radially outer blade tip of the turbine blade, and the radially outer blade tip is made up of a second, at least single-layer wear-resistant and oxidation-resistant protective coating which is built up by laser metal forming. The second protective coating on the blade tip overlaps along the outer and/or inner crown edge or web edge at least partially with the first, metallic protective coating arranged there.

In a method for producing a turbine blade as described above, in a preceding production step, at least portions of the surface of the main blade section of the turbine blade are coated with the oxidation-resistant, metallic protective coating, in particular a MCrAlY coating. An oxidation-resistant, ceramic thermal barrier coating is optionally applied to the protective coating. The method includes the following features:

- the at least one oxidation-resistant protective coating on the radially outer blade tip is removed by controlled machining, in particular grinding away, CNC milling and/or chemical coating removal, and
- the wear-resistant and oxidation-resistant protective coating is then applied to the blade tip in one layer or in a plurality of layers by known laser metal forming, such that said coating overlaps along the outer and/or inner crown edge or web edge at least partially with the first, metallic protective coating applied beforehand, but not with the ceramic thermal barrier coating (TBC) optionally applied beforehand.

The advantages of the invention are that the basic body of the turbine blade is protected against oxidation on all critical surfaces exposed to the hot gas, and at the same time the blade tip is tolerant to frictional contacts with the heat shield, and this makes it possible to reduce the size of the hot gas breach and thus to reduce the leakage losses. The efficiency of the turbine can thereby be increased significantly.

The blade according to the invention can be produced by an inexpensive and simple method.

The increased resistance to wear of the turbine blade with respect to frictional contacts makes it possible to apply relatively dense ceramic coatings to the heat shields. Good rub-in behavior can thus be combined with the requisite long-term erosion resistance of the ceramic coatings on the heat shields.

It is particularly advantageous that the turbine blade can be embedded in the rotor of the turbine directly following the laser metal forming (LMF step) without further heat treatment, and can thus be used for turbine operation.

Further advantageous refinements are described in the dependent claims.

By way of example, the metallic protective coating can be covered by a ceramic thermal barrier coating, and the second, oxidation-resistant and wear-resistant protective coating which is applied by laser metal forming overlaps at least partially only with the metallic protective coating, but not with the ceramic thermal barrier coating. As a result, optimum protection against oxidation is provided and the integrity of the TBC is not impaired, i.e. spalling of the TBC is prevented.

Furthermore, it is advantageous if the wear-resistant and oxidation-resistant protective coating is comprised of an abrasive material, which is preferably cubic boron nitride (cBN), and of an oxidation-resistant metallic binder material, in particular having the following chemical composition (amounts in % by weight): 15-30 Cr, 5-10 Al, 0.3-1.2 Y, 0.1-1.2 Si, 0-2 others, remainder Ni, Co.

Moreover, it is advantageous if the proportion of abrasive material in the wear-resistant and oxidation-resistant multilayer protective coating increases outward in the radial direction, because this ensures optimum adaptation to the load conditions.

The abrasive coating can be used for all types of turbine blades. In the case of blades without a shroud, the abrasive coating is applied to the crown (or to part of the crown). In the case of blades with a shroud, the method can be used to provide improved protection of the shroud web against wear.

The described embodiment of the turbine blade can be used both for producing new parts and for reconditioning (retrofitting). Here, only minimum adaptation of the existing production process is required.

A particularly interesting commercial potential is the retrofitting or reconditioning of existing blades. These blades can be modified by the disclosed method in order to achieve reduced leakage losses and thus improved efficiency of the turbine when they are refitted. For this option, it is not necessary beforehand to remove a protective coating which may already be present on the main blade section, and this makes a simplified production method possible.

DETAILED DESCRIPTION

Figure 2:
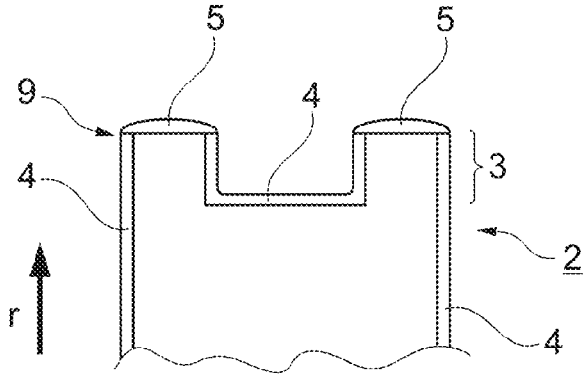
FIG. 2 shows a schematic section along line II-II in FIG. 1.

FIG. 1 is a perspective illustration of a turbine blade 1 for a rotor 13 (shown schematically) of a gas turbine, while FIG. 2 shows a section along line II-II in FIG. 1 in enlarged form. The turbine blade 1 has a main blade section 2, which extends in the radial direction r (in relation to the rotor) and is formed at the blade tip 9 as a crown 3 with inner and outer crown edges extending in the radial direction. The basic material of the main blade section is, for example, a nickel-based superalloy. The surface of the main blade section is coated at least at the crown edges (FIG. 2) with an oxidation-resistant protective coating 4, here a metallic MCrAlY coating, which was preferably applied by plasma spraying methods known per se. Said metallic protective coating 4 is not present at the radially outermost blade tip 9 of the turbine blade 1, specifically either because no such protective coating was applied in the preceding method steps for producing the turbine blade or because said protective coating has been removed with the aid of mechanical and/or chemical methods. In a last method step for producing the finished turbine blade, according to the disclosure the radially outer blade tip is built up from a second, wear-resistant and oxidation-resistant protective coating 5, which is built up by known laser metal forming, wherein said second protective coating 5 on the blade tip 9 overlaps along the outer and/or inner crown edge at least partially with the first, metallic protective coating 4 arranged there. The protective coating 5 may have a single-layer or else multi-layer form. The length L of the turbine blade 1 can readily be varied, in particular with multi-layer, overlapping protective coatings 5 applied by LMF.

The protective coating 5 is comprised of an abrasive material 6, which is preferably cubic boron nitride (cBN), and an oxidation-resistant binder material, which preferably has the following chemical composition (amounts in % by weight): 15-30 Cr, 5-10 Al, 0.3-1.2 Y, 0.1-1.2 Si, 0-2 others, remainder Ni, Co. A particularly suitable binder material which is actually used is, for example, the commercial alloy Amdry995.

Figure 3:
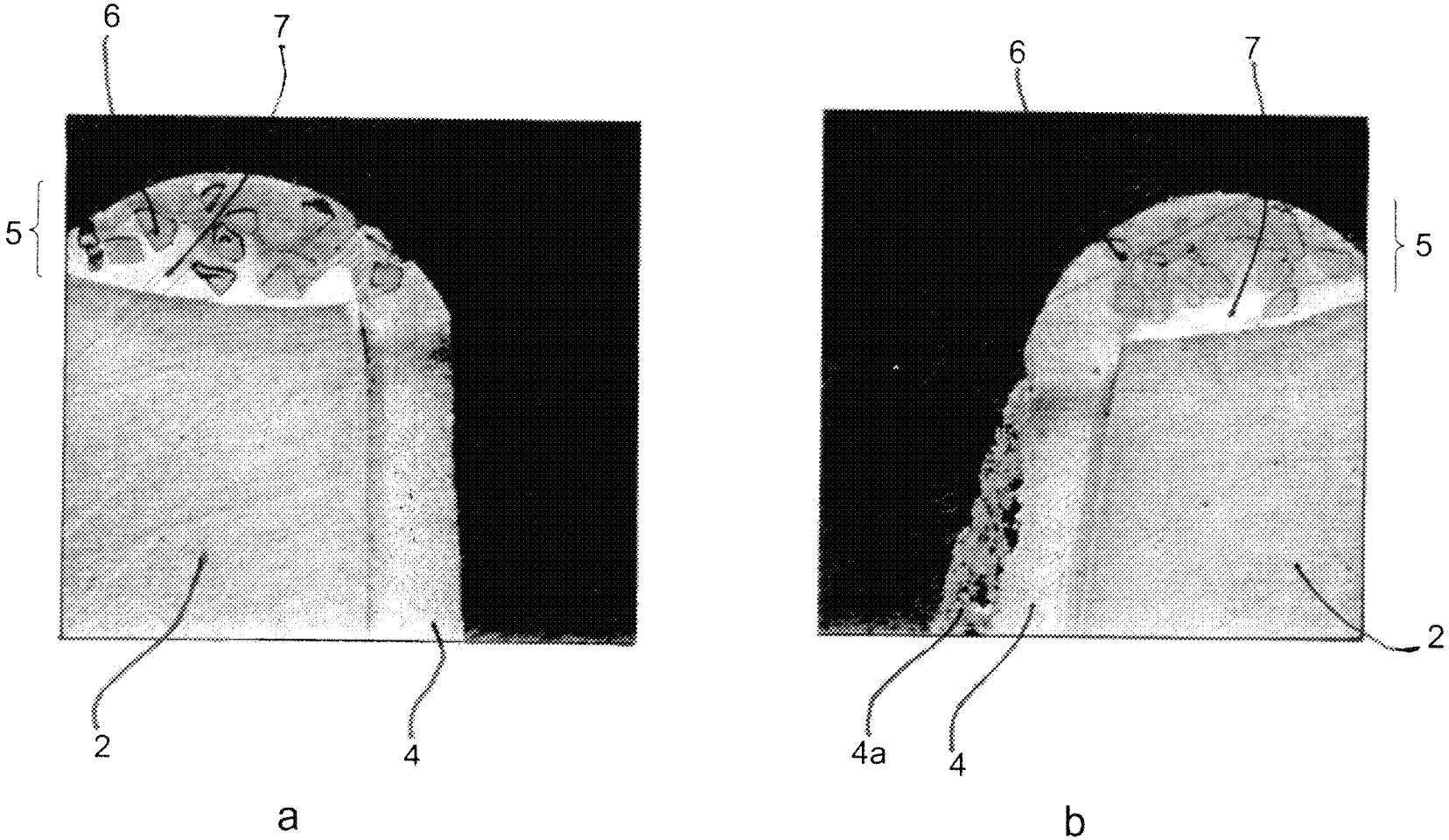
FIG. 3 shows photographic images, in two variants according to the invention, of wear-resistant and oxidation-resistant reinforcements, produced by the LMF method, of turbine blade tips.

This can be seen particularly well in FIGS. 3*a* and 3*b*, which show photographs of blade tips coated according to the disclosure. The pointy cBN particles embedded in the binder material 7 can readily be identified as abrasive material 6 in the wear-resistant and oxidation-resistant protective coating 5. This protective coating 5 was formed by LMF with the aid of a fiber-coupled high-power diode laser having a maximum output power of 1000 W. In FIG. 3*a* (on the left), the new coating partially overlaps with an MCrAlY protective coating 4, which is applied beforehand by plasma spraying. In FIG. 3*b*, the turbine blade 1 has an additional ceramic thermal barrier coating (TBC) 4*a* on the MCrAlY coating 4.

Figure 4:
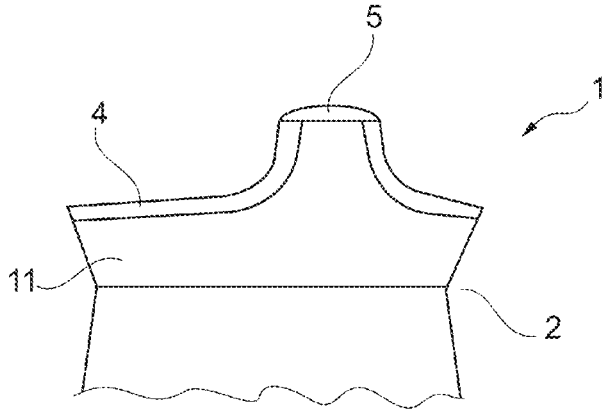
FIG. 4 is a schematic illustration of a further exemplary embodiment of the invention on the basis of a turbine blade with a shroud.

FIG. 4 schematically shows a further exemplary embodiment for a turbine blade 1 according to the disclosure with a shroud 11, which is arranged radially on the outside of the blade tip and has a web 12. In this case, as well, a very high-quality blade can be obtained owing to the wear-resistant and oxidation-resistant protective coating 5, which is applied by LMF and at least partially overlaps the metallic protective coating 4.

The special feature of the approach described here is the special design of such a wear-resistant protective coating 5. The single-layer or multi-layer coating 5 is applied such that it at least partially overlaps with other, existing protective coatings 4. By way of example, the existing protective coatings 4 are MCrAlY coatings known from the prior art (M=Ni, Co or a combination of both elements) which, in the case of most turbine blades subjected to high levels of loading, protect the surfaces of the main blade section against oxidation and corrosion. Furthermore, a ceramic thermal barrier coating (TBC) may additionally be applied to said MCrAlY coating on the main blade section, and the integrity of this thermal barrier coating is not impaired by the proposed method.

Owing to the overlapping with the existing protective coatings, the proposed embodiment of an oxidation-resistant abrasive coating on the blade tip ensures that the surfaces of the blade tip which are exposed to the hot gas are efficiently protected. Application of this wear-resistant coating by the LMF method also makes it possible to schedule this coating operation as the last production step in the production process. The following technical problems are thereby avoided:

- In the case of the MCrAlY coating, the surface has to be freed from oxides in advance by sandblasting and/or cleaning with a transferred arc, in order to ensure an optimum bond. An abrasive coating applied by conventional (e.g. electrodeposition) methods would have to be protected against damage by appropriate masking during the preparation for the MCrAlY coating, and this would result in increased complexity and additional costs.
- MCrAlY coatings are usually produced by plasma spraying. After the coating has been applied, a diffusion heat treatment step is required at temperatures in the region >1050° C. In this process step, the high temperatures can have a negative effect on the properties of abrasive coatings which have been applied previously.

The above-mentioned problems are avoided if, as described here, the abrasive coating is applied by laser metal forming as the last step in the process chain. A simple and inexpensive implementation lies in completely removing the radially outer MCrAlY (if appropriate, also TBC) coating(s) by milling away or grinding away or by chemical processes by a defined amount. The wear-resistant coating is then applied by LMF to the then exposed basic material. A decisive factor here is the locally very limited action of the laser beam, which, if the process is carried out in a controlled manner, keeps the effects on the adjacent regions of the blade to a minimum. It is thus possible to apply such a wear-resistant coating in the immediate vicinity of a TBC protective coating without damaging the latter (see, for example, FIG. 4*b*).

In contrast to conventional (e.g. electrodeposition) coating methods, those surfaces of the turbine blade 1 which are not to be coated (e.g. the blade root) do not have to be protected by a masking method. The LMF process is a welding method and produces a stable, metallurgical bond with the basic body of the blade without additional diffusion heat treatment. Owing to the small local introduction of heat, the local hardening is kept to a minimum despite the rapid solidification process. The component can thus be installed immediately after the wear-resistant protective coating has been applied, without further, subsequent steps.

Figure 5:
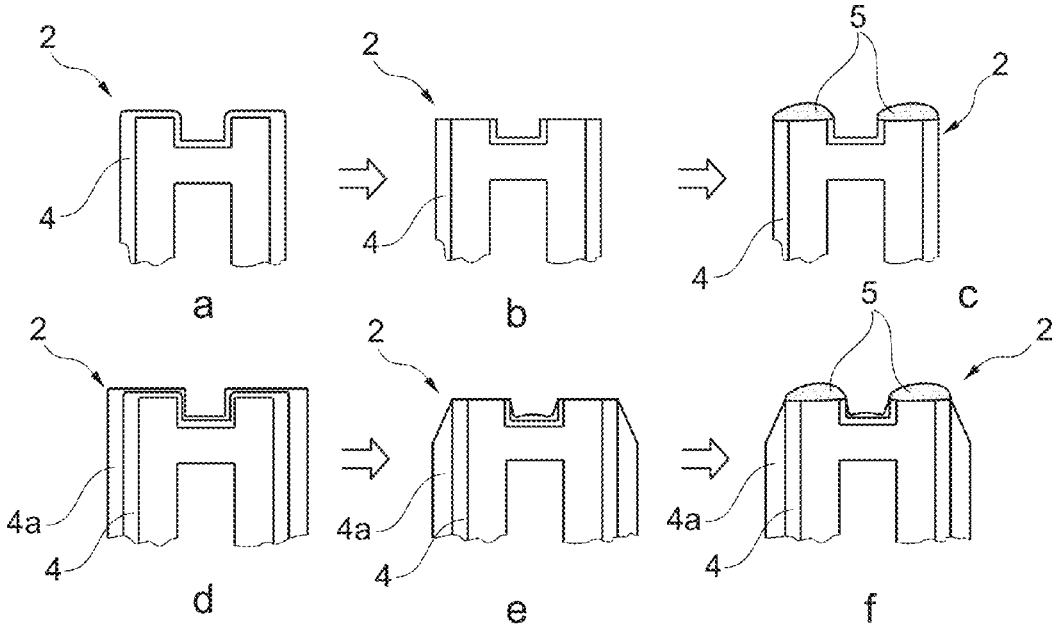
FIGS. 5*a*-5*f* show, in two variants, the production sequence for the production of a turbine blade according to the invention.

FIG. 5 shows various possible implementations. In the first design variant (FIGS. 5*a* to 5*c*), the wear-resistant MCrAlY protective coating 4 is firstly applied to the main blade section 2, e.g. by plasma spraying. Said protective coating 4 is then removed locally at the blade tip, e.g. by milling away or grinding away (FIG. 5*b*). As the last operation, the wear-resistant and oxidation-resistant protective coating 5 is applied by the LMF method. In this case, the protective coating 5 applied last at least partially overlaps with the oxidation-resistant MCrAlY protective coating 4 applied beforehand (FIG. 5*c*). The entire blade body is thereby protected against oxidation at high operating temperatures.

As already described above, it is possible, in a further preceding production step, to provide the blade tip with an additional thermal barrier coating 4*a*. In the design variant shown in FIG. 5*f*, the wear-resistant protective coating 5 is only applied to the blade tip by laser metal forming after the TBC coating 4*a* (FIG. 5*d*) and after the MCrAlY coating 4 and TBC coating 4*a* have been ground away (FIG. 5*e*). In this case, suitable control of the coating head (e.g. by a robot or a CNC) ensures that no interaction takes place between the laser beam and the ceramic coating during the LMF method. Just as in the first variant, however, the wear-resistant and oxidation-resistant protective coating 5 overlaps with the MCrAlY protective coating 4 applied beforehand, in order to ensure optimum protection of the main blade section 2 against oxidation. Owing to the locally limited and minimized introduction of heat, it is possible to carry out the LMF method in the immediate vicinity of the ceramic thermal barrier coating 4*a*, without spalling of the TBC occurring.

Figure 6:
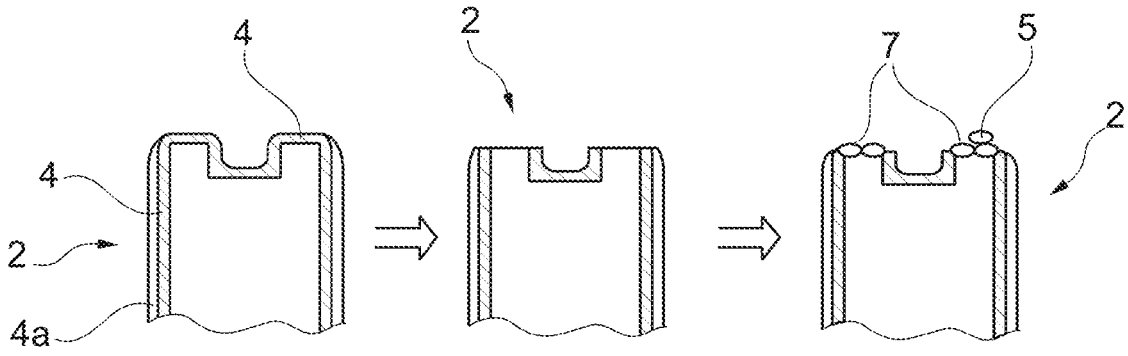
FIG. 6 shows, in a further variant, the production sequence for the production of a turbine blade according to the invention.

A further exemplary embodiment is shown in FIG. 6: this variant can be used, for example, when the crown 3 of the turbine blade 1 is so wide that the wear-resistant and oxidation-resistant protective coating 5 cannot be applied with an individual weld pass. In such cases, at least one multi-strip, overlapping intermediate coating 8 comprised of oxidation-resistant binder material 7 can firstly be applied. At least one further strip is then applied to the coating(s) deposited first with the combined supply of binder material 7 and abrasive material 6. Here, it is not necessary for the abrasive particles 6 to be distributed over the entire width of the blade tip 9. The variant shown in FIG. 6 thus makes cost-optimized production of the oxidation-resistant and wear-resistant blade tip possible.

Figure 7:
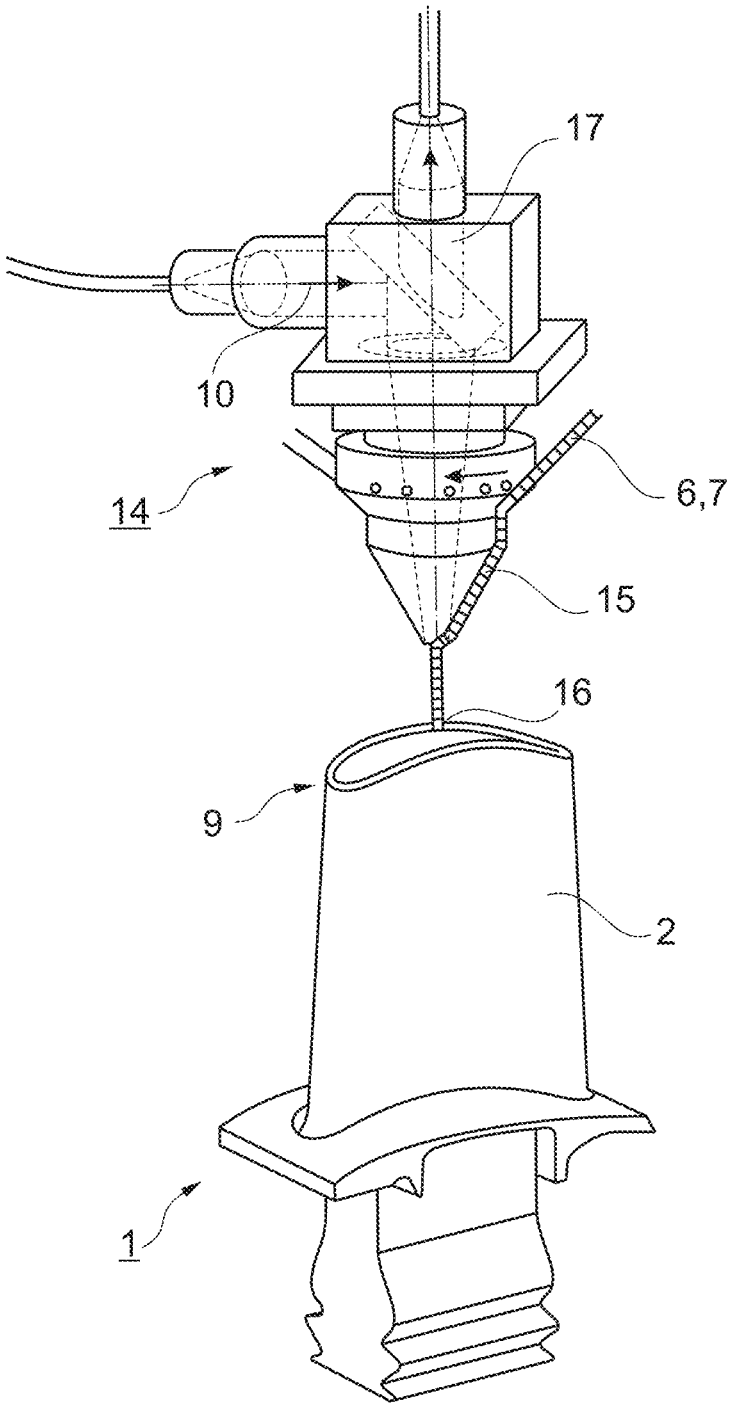
FIG. 7 shows an exemplary coating apparatus for the LMF method.

FIG. 7 shows an exemplary coating apparatus 14 for carrying out the last step of the method. The apparatus 14 is described in detail in U.S. Pat. No. 7,586,061 (B2), the contents of which are incorporated by reference as if fully set forth. When subjecting the blade tip 9 to laser metal forming, abrasive material 6 and oxidation-resistant binder material 7 are mixed in a powder nozzle, transported by a carrier gas 15 and then injected concentrically about the laser beam 10 as a focused jet of powder into the melt pool 16 produced by the laser beam 10 on the blade tip 9. The temperature or temperature distribution in the melt pool is additionally recorded online during the laser metal forming (optical temperature signal 17), and this information is used, with the aid of a control system (not shown), to control the laser power during the laser metal forming and/or to change the relative movement between the laser beam 10 and the turbine blade 1 in a controlled manner.

The invention can be used manifoldly for shroud-less turbine blades, but also for components having a shroud. The service life of the abrasive coating, which is dependent on the respective operating conditions (temperature, fuel), must be taken into consideration. The service life is optimized by good distribution and complete embedding of the abrasive particles in the oxidation-resistant binder matrix. Nevertheless, the main aim is to protect the turbine blade tip above all during the run-in phase. This corresponds to a duration of several dozen to several hundred operating hours.

It goes without saying that the invention is not restricted to the exemplary embodiments described.

LIST OF REFERENCE SYMBOLS

1 Turbine blade
2 Main blade section
3 Crown
4, 4*a* First, oxidation-resistant protective coating (4 metallic coating, 4*a* ceramic thermal barrier coating)
5 Second, wear-resistant and oxidation-resistant protective coating
6 Abrasive material
7 Binder material
8 Intermediate coating comprised of oxidation-resistant binder material
9 Blade tip
10 Laser beam
11 Shroud
12 Web
13 Rotor
14 Coating apparatus
15 Carrier gas
16 Melt pool
17 Optical temperature signal
r Radial direction
L Length of the turbine blade

What is claimed is:

1. A turbine blade for a turbine rotor, the turbine blade comprising:

a main blade section having a blade tip and extending in a radial direction wherein the blade tip is formed either as a crown, with an inner and outer crown edge extending in the radial direction, or as a shroud with a web, extending in the radial direction and having lateral edges and;

at least one first protective coating comprised of an oxidation-resistant material provided at, at least portions of a surface of the main blade section, the at least one first oxidation-resistant protective coating is a metallic coating, the first protective coating is arranged at least at the inner and/or outer crown edge or at the web edges, the first protective coating is not present at the radially outer blade tip of the turbine blade; and a second, at least single-layer wear-resistant and oxidation-resistant protective coating provided at the radially outer blade tip, the second protective coating being built up by laser metal forming, said second protective coating on the blade tip overlapping along the outer and/or inner crown edge or the web edges at least partially with the first, metallic protective coating arranged there;

wherein the wear-resistant and oxidation-resistant protective coating consists of an abrasive material and an oxidation-resistant metallic binder material.

2. The turbine blade as claimed in claim 1, comprising:

a ceramic thermal barrier coating covering the at least one metallic protection coating, and wherein the second, oxidation-resistant and wear-resistant protective coating which is applied by laser metal forming, overlaps at least partially only with the metallic protective coating, but not with the ceramic thermal barrier coating.

3. The turbine blade as claimed in claim 1, wherein the abrasive material is cubic boron nitride.

4. The turbine blade as claimed in claim 1, wherein the oxidation-resistant binder material has the following chemical composition: 15-30% by weight Cr, 5-10% by weight Al, 0.3-1.2% by weight Y, 0.1-1.2% by weight Si, 0-2% by weight others, remainder Ni, Co.

5. The turbine blade as claimed in claim 1, wherein the proportion of abrasive material in the protective coating, if said coating has a multi-layer form, increases outward in the radial direction.

6. The turbine blade as claimed in claim 1, comprising:

an intermediate coating, which consists exclusively of oxidation-resistant binder material, arranged between the first, metallic protective coating and the second, wear-resistant and oxidation-resistant protective coating, the intermediate coating at least partially overlaps the first protective coating and the second protective coating in turn at least partially overlaps the intermediate coating.

7. The turbine blade as claimed in claim 1, wherein the turbine blade is a reconditioned turbine blade.

8. The turbine blade as claimed in claim 7, wherein the turbine blade was used in a preceding service interval of the turbine without an abrasive blade tip.

9. The turbine blade as claimed in claim 1, wherein the turbine blade is a new component.

10. The turbine blade as claimed in claim 1, having a length, wherein the length can be varied by the coatings built up by laser metal forming.

11. The turbine blade as claimed in claim 1, wherein the first protection coating is an MCrAlY coating.

12. A method for producing a turbine blade for a turbine rotor, the turbine blade comprising:

a main blade section having a blade tip and extending in a radial direction wherein the blade tip is formed either as a crown, with an inner and outer crown edge extending in the radial direction, or as a shroud with a web, extending in the radial direction and having lateral edges, at least one first protective coating comprised of an oxidation-resistant material provided at, at least portions of a surface of the main blade section the at least one first oxidation-resistant protective coating is a metallic coating, the first protective coating is arranged at least at the inner and/or outer crown edge or at the web edges, the first protective coating is not present at the radially outer blade tip of the turbine blade; and a second, at least single-layer wear-resistant and oxidation-resistant, protective coating provided at the radially outer blade tip, the second protective coating being built up by laser metal forming, said second protective coating on the blade tip overlapping along the outer and/or inner crown edge or the web edges at least partially with the first, metallic protective coating arranged there, the method comprising:

coating, in a preceding production step, at least portions of the surface of the main blade section of the turbine blade with the oxidation-resistant, metallic protective coating (4)

removing the at least one oxidation-resistant protective coating on the radially outer blade tip by controlled machining, in particular grinding away, CNC milling and/or chemical coating removal; and applying the wear-resistant and oxidation-resistant protective coating to the blade tip in one layer or in a plurality of layers by laser metal forming, such that said coating overlaps along the outer and/or inner crown edge or the web edges at least partially with the first, metallic protective coating.

13. The method as claimed in claim 12, comprising during the laser metal forming step of the blade tip, abrasive material and oxidation-resistant binder material are mixed in a powder nozzle and then injected concentrically about a laser beam as a focused jet of powder into a melt pool produced by the laser beam on the blade tip.

14. The method as claimed in claim 13, wherein a temperature or temperature distribution in the melt pool is additionally recorded online during the laser metal forming, which is used, with the aid of a control system, to control the laser power during the laser metal forming and/or to change the relative movement between the laser beam and the turbine blade in a controlled manner.

15. The method according to claim 12, wherein the first protection coating is an MCrAlY coating.

16. The method according to claim 12, comprising:

providing a ceramic thermal barrier coating covering the at least one metallic protection coating, and wherein the second, oxidation-resistant and wear-resistant protective coating which is applied by laser metal forming, overlaps at least partially only with the metallic protective coating, but not with the ceramic thermal barrier coating.

* * * * *

UNITED STATES PATENT AND TRADEMARK OFFICE

CERTIFICATE OF CORRECTION

PATENT NO. : 8,740,572 B2
APPLICATION NO. : 12/917114
DATED : June 3, 2014
INVENTOR(S) : Matthias Hoebel et al.

It is certified that error appears in the above-identified patent and that said Letters Patent is hereby corrected as shown below:

In the Claims:

Column 8, Claim 12, line 66: change "section" to --section,--

Column 9, Claim 12, line 15: delete "(4)"

Signed and Sealed this
Ninth Day of September, 2014

Michelle K. Lee

Michelle K. Lee
*Deputy Director of the United States Patent and Trademark Office*